US007650948B2

(12) United States Patent
Rousseau et al.

(10) Patent No.: US 7,650,948 B2
(45) Date of Patent: Jan. 26, 2010

(54) SELF SERVICING FIRE EXTINGUISHER WITH WALL MOUNTING BRACKET AND POWDER FLUFFING APPARATUS

(76) Inventors: Hector Rousseau, P.O. Box 70616, Riverside, CA (US) 92513; Randy Rousseau, P.O. Box 70616, Crestline, CA (US) 92513

( * ) Notice: Subject to any disclaimer, the term of this patent is extended or adjusted under 35 U.S.C. 154(b) by 322 days.

(21) Appl. No.: 11/714,611

(22) Filed: Mar. 6, 2007

(65) Prior Publication Data

US 2008/0053667 A1 Mar. 6, 2008

Related U.S. Application Data

(63) Continuation-in-part of application No. 11/515,471, filed on Sep. 1, 2006, now Pat. No. 7,318,484, which is a continuation-in-part of application No. 11/266,815, filed on Nov. 4, 2005, now Pat. No. 7,128,163.

(51) Int. Cl.
*A62C 25/00* (2006.01)

(52) U.S. Cl. ..... 169/51; 169/9; 169/23; 169/30; 169/72; 169/75; 169/77; 169/85; 169/88; 239/142; 239/288; 239/373; 222/226; 222/399; 366/279; 366/332; 366/343; 406/135; 340/326; 340/568.8; 340/691.1; 248/311.2; 248/312.1; 248/313; 248/551

(58) Field of Classification Search ..... 169/9, 169/23, 30, 51, 71, 72, 76, 77, 85, 88, 89, 169/75; 239/142, 143, 288–288.5, 325, 373; 222/195, 226, 395, 399, 630; 366/102–104, 366/279, 332, 342, 343; 406/38, 134, 135; 248/75, 311.2, 312.1, 313, 551; 340/289, 340/326, 568.8, 691.1, 693.1, 693.5
See application file for complete search history.

(56) References Cited

U.S. PATENT DOCUMENTS

| | | | | |
|---|---|---|---|---|
| 1,272,012 | A | 7/1918 | Connor | |
| 1,733,724 | A | 10/1929 | Downs | |
| 2,067,829 | A | 1/1937 | Dennel | |
| 2,221,370 | A * | 11/1940 | Charnock | 169/51 |
| 2,234,360 | A * | 3/1941 | Whitson | 169/51 |
| 2,430,470 | A | 11/1947 | Keefe, Jr. | |
| 2,489,339 | A | 11/1949 | Stroop | |
| 2,499,672 | A * | 3/1950 | Nurkiewicz | 248/313 |
| 2,541,554 | A | 2/1951 | Smith | |
| 2,785,759 | A | 3/1957 | Fleming et al. | |
| 3,255,824 | A | 6/1966 | Rodgers | |
| 3,618,669 | A | 11/1971 | Sachs | |

(Continued)

*Primary Examiner*—Steven J Ganey
(74) *Attorney, Agent, or Firm*—Kirk A. Buhler; Buhler & Associates

(57) ABSTRACT

Improvements to a portable fire extinguisher where the improvements relate to a system where the owner of the extinguisher can service and maintain their fire protection. Systems in place today require the servicing of a third party. The service companies (third parties) are charged with maintaining the system. Further Improvements include an anti-bridging mechanism that is articulated from the exterior of the chamber to fluff, mix or stir the powder within the chamber to keep it in a liquefied state. The improvements further include a wall mounting bracket that reduces tampering with the extinguisher, an automatic fluffing motor and manual fluffing wheel with a chuck for use with a drill. These features extend the service intervals while maintaining the fire extinguisher in a ready condition. The fire extinguisher is construction of components that are interchangeable and provide equal operation for left and right handed people.

18 Claims, 4 Drawing Sheets

U.S. PATENT DOCUMENTS

| | | | | |
|---|---|---|---|---|
| 3,713,493 | A | | 1/1973 | Hansen |
| 3,893,095 | A | | 7/1975 | DeJong |
| 4,015,250 | A | | 3/1977 | Fudge |
| 4,236,148 | A | | 11/1980 | Gurvis |
| 4,360,802 | A | | 11/1982 | Pinto |
| 4,372,394 | A | | 2/1983 | Allegri, Sr. |
| 4,567,948 | A | | 2/1986 | Rozniecki |
| 4,592,301 | A | | 6/1986 | Monte |
| 4,650,004 | A | | 3/1987 | Wendling et al. |
| 4,862,968 | A | | 9/1989 | Woodman |
| 5,153,567 | A | * | 10/1992 | Chimento ..... 169/23 |
| 5,638,907 | A | | 6/1997 | Salmonsen |
| 5,793,280 | A | | 8/1998 | Hincher |
| 6,124,796 | A | | 9/2000 | Hincher |
| 6,189,624 | B1 | | 2/2001 | James |
| 6,527,058 | B1 | | 3/2003 | Nerat |
| 6,641,286 | B2 | | 11/2003 | Hincher |
| 7,287,735 | B2 | * | 10/2007 | Heerdt et al. ..... 248/311.2 |

* cited by examiner

SELF SERVICING FIRE EXTINGUISHER WITH WALL MOUNTING BRACKET AND POWDER FLUFFING APPARATUS

CROSS REFERENCE TO RELATED APPLICATION

This application is a continuation-in-part of applicant's application Ser. No. 11/515,471 filed Sep. 1, 2006, now U.S. Pat. No. 7,318,484, which is a continuation-in-part of application Ser. No. 11/266,815 filed Nov. 4, 2005 now U.S. Pat. No. 7,128,163 the entire contents of which is hereby expressly incorporated by reference herein.

DESCRIPTION

1. Field of the Invention

This invention relates to improvements in portable fire extinguishers or delivery system. More particularly, the present invention relates to a fire extinguisher that allows for external mixing, fluffing, actuating or stirring of the powder within the chamber to provide anti-bridging of the powder to keep it in a liquefied state. The improvements further include a wall mounting bracket that reduces tampering with the extinguisher, an automatic fluffing motor and manual fluffing wheel with a chuck for use with a drill.

2. Background of the Invention

Most portable fire extinguishers are of a similar design where the fire extinguishing powder is contained in a pressurized chamber. Fire extinguishers of this type require scheduled maintenance because the powder within the chamber can settle and cake preventing it from being dispensed when needed. The pressure within the chamber may also leak over time and be insufficient to propel the powder out of the dispensing nozzle. A further limitation, based upon this design is due to the pressurized condition of the chamber, powder is placed into the chamber in a small opening in the top of the extinguisher. This scheduled maintenance allow moisture intrusion causing caking. Current extinguishers can only be service by trained certified technicians, and the certification is issued by the fire marshal for each state. The current fire system in place today requires the services of a third party. The service companies (third parties) are charged with maintaining the system. They cannot in fact meet the standards required of them. They cannot meet the requirements of the UL label. Nor can they meet the manufacturer's requirements.

UL states each extinguisher must be maintained in the same manner as it was tested. The powder must be the manufacturer's powder. The lubricants must be the same manufacturer's brand. The hanger must be of the same manufacturer. If these requirements are not met the UL listing is voided and the extinguishers must be recalled. It is impossible for any service company to meet these requirements. All service firms perform the maintenance of the extinguishers in service vehicles. These vehicles are small vans or pick-up trucks. They can carry at most two recovery systems, one for ABC and one for BC. There are no service vehicles capable of carrying a recovery system for each brand of extinguisher as required by UL. All extinguishers in service today have contaminated powder and the UL has been voided. This also speaks to the lubricants and parts as well.

The manufacturer and NFPA-10 standards also impose standards that cannot be met by the service firms. The manufacturers require that only their powder, parts and lubricants must be used in their products. They also require standard for the servicing of the same. The concern for the environmental impact on their powder i.e. the humidity level, the amount of air the powder is exposed too, the mixing of powder. The manufacturers produce their product in a controlled environment and as such can protect against caking and maintaining a fluid effect with their powder. The current extinguishers use chemical recycled thru a recovery system thus the mixing of chemicals. This extinguisher has the only enclosed chemical cartridge and no mixing of the chemical can take place.

Mixing the powder and using their own brand of lubricants and parts they allow an abundance of air in various stages to compromise the powder. Currently the only prevention for this is to never open the extinguisher and to return it to the manufacturer when it is required to be hydro tested or to have the six-year tear down to clear the powder. It is commonly understood that because the current system is made up of pressurized portable fire extinguishers resulting in the compaction of the powder and therefore must be fluffed. The current system is plagued with serious problems. The service firms have very little supervision and are in a position to abuse the public. Most enforcement officers are charged with other more serious duties, i.e. arson etc. and has little time to dedicate to a system that is in fact impossible to maintain. The vast majorities of service firms operate out of the back of their trucks and are continually on the move, making them difficult to locate and to implement any type of enforcement.

Another limitation with portable fire extinguishers that are currently available is that the fire extinguishes can only be shipped by land because they are pressurized, and could rupture when they are shipped by air. The around shipping is a HASMAT requirement that the proposed portable fire extinguisher would not have because the tank is not pressurized.

Current extinguishers are open to wear and tear because of the constant pressure and the tear down process. When serviced they are fired into a recycling chamber and all the parts must be disassembled and cleaned. All the pressure rings must be replaced and every part must them be reassembled with new powder being placed within the chamber prior to pressurizing the chamber. The servicing of current fire extinguishers often creates more wear and tear on the fire extinguisher than when it is used to extinguish a fire.

U.S. Pat. No. 6,189,624 issued to James on Feb. 20, 2001 and Japan Patent Number JP9,225,056 issued to Yamazaki Tomoki on Sep. 2, 1997 disclose fire extinguishing mechanisms where the chamber is not continuously pressurized, and the pressurized chamber is a separate entity integrated within the chamber. While these patents disclose a separate pressurized canister, the canister is not located in a position that is easy to service, replace, or inspect. This minimizes the ability determine the charge level of the $C0_2$ cartridge.

U.S. Pat. No. 2,541,554 issued to C H Smith on Feb. 13, 1951 and Russian Patent Number RU 2,209,101 issued to Glavatski G. D. Et Al. Nov. 2, 2002 discloses a fire extinguisher with external $CO_2$ gas cartridge. In the case US '554 the $CO_2$ gas cartridge sits on top of the fire extinguisher chamber and is not integrated within the handle of the fire extinguisher. In the case of RU '101 the $CO_2$ gas cartridge is external to the extinguisher and is connected to the extinguisher with a pipe or hose. While both of these patents disclose a $CO_2$ cartridge that is external to the chamber, neither of them is placed in the handle to allow a configuration of the fire extinguisher that is simple to inspect and replace.

Russian Patent Number RU2,209,101 issued to Glavatski G. D. Et Al. Nov. 2, 2002 discloses a fire extinguisher with an internal fluffing mechanism consisting of a coiled spring. It is known that one of the problems with powder type fire extinguishers is the possibility that the extinguishing powder within the chamber can cake and harden if it is not fluffed to keep the powder in liquid configuration. While the RU '101 patent discloses a fluffing mechanism, the fluffing mechanism is operated by a wound spring, and one the spring has been used there is no mechanism to wind the spring. The proposed product does not have this limitation because it provides an external mechanical interface that allows a user to manually fluff the powered.

Due to the pressurized condition that exists with pressurized fire extinguishers, the opening where powder is placed into the extinguisher is limited due to the structural requirement to maintain pressure within the chamber at all times. The proposed application eliminates this need by providing an external pressurized gas cartridge, thus allowing the chamber to exist in a normally un-pressurized condition. Because the chamber is not under pressure the top opening of the extinguisher can be enlarged to allow easier filling of the fire extinguisher with powder, or checking the amount and or condition of the powder within the chamber. This extinguisher does not require this testing, it is not pressurized constantly, only when it is needed to extinguish a fire and then it only holds pressure for the maximum of a minute.

A number of patents have been issued that include an audible alarm to indicate that a fire extinguisher has been moved or taken. Exemplary examples of these patents include U.S. Pat. No. 4,360,802 issued to Anthony A. Pinto on Nov. 23, 1982, U.S. Pat. No. 4,592,301 issued to Anthony J. Monte on Jun. 3, 1986 and U.S. Pat. No. 3,893,095 issued to Dennis E. DeJong on Jul. 1, 1975. While these patents disclose a signaling means to announce that the fire extinguisher has been removed, none of them disclose a wireless indicator, or due they provide for a mixing mechanism for fluffing the internal contents of the fire extinguisher.

The conventional bracket in use today has no deterrents regarding tampering. The tamper seal (plastic strap) is easily broken and the safety pin is accessible to anyone wanting to remove It. I.e. disgruntle employees, customers etc. If either the strap or the pin is tamper with that extinguisher must be fired off and broken down and totally cleaned and refilled and re-certified.

What is needed is a fire extinguisher with an external gas cartridge where the gas cartridge is located in the handle, a fluffer is accessible from outside the chamber. The ideal product would also include a wall mounting bracket for the extinguisher that has a mechanical fluffing mechanism. The ideal wall mounting bracket would also have a protector for the activation mechanism of the fire extinguisher. The proposed fire extinguisher provides this solution by providing a fire extinguisher and a wall mounting bracket with the features needed.

BRIEF SUMMARY OF THE INVENTION

It is an object of the fire extinguisher to eliminate the need for service personnel to enter secure areas. The extinguisher can have a higher level of service. Can be operated automatically "self service" and or manually services by the owner or end user. This eliminates the need for non-employees to enter the privacy of business and government areas. This extinguisher can be operated, maintained, refilled and charged with no special training or equipment allowing for anyone who purchases it to have it function like any of the office equipment that is available to day like a copier, printer or water cooler. The proposed fire extinguisher is not required to be broken down when it has been fired.

The reduced outside servicing and maintenance of the fire extinguisher is ideal for placement of the fire extinguisher to be placed in secure areas. This will reduce or eliminate the possibility that a terrorist could utilize the fire extinguisher as a weapon, or use false identity as an extinguisher service person to gain access to a secure area.

It is an object of the fire extinguisher to provide a fire extinguisher with an external pressurized canister. The external canister allows the chamber to exist at or near ambient pressure that reduces the need to utilize a high strength chamber. The standard pressurized cartridge that is used in other applications can be easily adapted to operate with the fire extinguisher. Since the pressurized cartridge is external to the chamber it can be easily replaced or swapped without replacing the entire fire extinguisher. This provides a tremendous benefit when a large number of fire extinguishers need to be in service at one time.

It is another object of the fire extinguisher to provide a fire extinguisher with an externally accessible fluffing mechanism. The externally accessible fluffing mechanism promotes anti-bridging of the powder within the chamber to keep it fluffed, agitated, stirred or disturbed to prevent caking of the powder and keep the powder in a liquefied state so it is easier to spray the powder onto a fire. The fluffing is accomplished with paddles, flapper, chains rods or other mixing mechanisms located within the chamber. The mixing mechanism is accessed by a connection on the top, bottom or side of the chamber and can be either manually operated or operated with a key of some type.

It is another object of the fire extinguisher to provide automatic fluffing of the media inside the fire extinguisher using a powered fluffing mechanism that is powered with batteries, wind-up mechanism or is externally powered. A timing device can be used to fluff the contents at pre-defined intervals, or the mixing can be performed continuously at a predefined rate of rotation.

It is another object of the extinguisher to provide an extinguisher where there is no need for any tear down the powder is contained in the manufacturer's cartridge and the powder can be fluffed by the external mechanism at the base of the cartridge. The fluffier can be operated manually or with an electric motor, hard wired or battery operated. This extinguisher can be produced with a clear powder cartridge and the fluffing can be visibly inspected. This extinguisher provide the operator with several options such as the ability to recharge and fire as needed and to fire different fire retardant and it can also fire a liquid product. Fire departments can fire and recharge at the site, they no longer have to wait for a service firm to recharge the extinguisher.

It is another object of the extinguisher to provide a delivery systems that accommodated as much chemical as the cartridges available at the scene, five, ten, twenty, thirty, forty etc. without providing a limitation based upon the chemical and extinguisher sizes that are currently available.

It is another object of the fire extinguisher to provide a fire extinguisher that can be filled or refilled with a changeable canister of fire resistant material. The canister consists of a cup shaped cylinder that can be slid into the bottom or top of the fire extinguisher. Various types of fire extinguishing media can be installed and or changed by removing the bottom or top of the extinguisher and sliding a new or different type of fire extinguishing media inside of the fire extinguisher shell, and re-installing the bottom or top.

It is another object of the fire extinguisher to provide a fire extinguisher that can be shipped by overnight or air carrier. Since the fire extinguisher exists in a non-pressurized condition there is no hazard of explosion of the pressurized canister. The pressurized canister is inserted into the fire extinguisher when it arrives at its destination.

It is another object of the fire extinguisher to provide a delivery system which dispenses various types of fire retardant and can be reused at the point of attack without the need for special pressurized equipment or specially trained certified personnel. This extinguisher is specially designed so that all parts are interchangeable. These features provide a wider range of fire suppression available for the on line fire fighters.

It is another object of the fire extinguisher to provide a fire extinguisher with interchangeable parts where the heads and cylinders of each of the extinguishers can be interchanged with the head and cylinder from another fire extinguisher. Today each extinguisher must be refitted with the head it was manufactured with. If the heads are not replaced on the manufactured cylinder the instruction labels and the gauges do not line up and the extinguisher must be condemned. The current extinguishers display the instructions on the left side of the extinguisher and the safety pin is on the left side of the extinguisher, the gauge is on the left side of the extinguisher each of these make it difficult for the user who is right handed. This extinguisher has the instructions on the top, making it easier for both the right and left handed users.

It is another object of the fire extinguisher to provide a fire extinguisher that does not have a gauge. The current extinguishers cannot be refilled or recharged by the owner they must be recharged and pressurized by a third party. This extinguisher can be recharged by the end user, the owner. Current extinguishers can only be used with the designated powder it is filled with and because each extinguisher is pressurized it can only be recharged by a certified technician with the necessary pressurizing equipment. This extinguisher has a cartridge loaded powder with a fluffing mechanism and is interchangeable for whatever retardant is required. It is not pressurized and can be changed by the operator. This extinguisher is only pressurized when it is needed to extinguish a fire. Current extinguishers are pressurized at 195 PSI and over a period time this creates compacting and bridging and the pressure can leak out of the cylinder.

It is another object of the fire extinguisher that includes the chemical cartridge and the fluffier and the head (delivery system) in a complete unit. The major uniqueness is the over all user friendly system. This extinguisher is a system for the multi delivery of fire retardant. This extinguisher eliminates the need for a government regulated ineffective third party and places the responsibility for protection in the hands of the individual. The current extinguisher requires a separate extinguisher for each chemical retardant, i.e. ABC, BC, Purple K etc. This extinguisher with its delivery head can apply all chemicals.

It is another object of the fire extinguisher to provide a fire extinguisher that can deliver as much retardant and the correct type of retardant called for at the immediate fire location. With the proposed fire extinguisher the fire retardant is no longer limited by the delivery system. The retardant can be available on the fire fighters equipment and can be dispensed at the scene. The proposed fire extinguisher has the chemical separately contained in fire resistant plastic cartridges that are clearly marked with the corresponding chemicals required for the immediate fire threat.

It is another object of the fire extinguisher to provide a fire extinguisher with a wall mounted bracket that has tamper deterrent the base of the bracket extends to cover the safety cover over the pressurizing trigger. The safety strap and the pull pin have been replaced on the eliminator extinguisher. This cartridge operated extinguisher has a pressure trigger which is protected by a safety cover. The design of this bracket provides a double safety feature. When the extinguisher is placed into the bracket the top is secure by a cover that snaps over the top of the extinguisher. The extinguisher must be removed and the second deterrent must be violated to fire the extinguisher.

It is another object of the fire extinguisher bracket to have additional features such as a simple plunger device which can be attached to the base of the bracket and will be activated if the extinguisher is removed, a flashing light can also be attached to add to the deterrent and to notify others regarding the location of a fire or where an extinguisher has been removed.

It is another object of the fire extinguisher bracket for the bracket to be fabricated in a material that glows in the dark material which would assist in the event of a power loss and would function as a night light.

It is still another object of the fire extinguisher for the extinguisher to have a fluffing wheel that is designed specifically for the eliminator extinguisher. It can be operated by hand or powdered. The wheel is attached at the base of the extinguisher. The fluffing wheel is snapped on to the internal agitator. It is easily activated and if the operator find the wheel difficult to turn the entire powder cartridge should be replaced. The chamber is not pressurized so the powder should be fluffed without any difficulty. The fluffing wheel is operable with a fluffing chuck that is designed specifically for the fluffing wheel. The cluck fits any of the current drills in use today. It is circular and has multiple extended arms which fit into the fluffing wheel attached to the base of the extinguisher.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
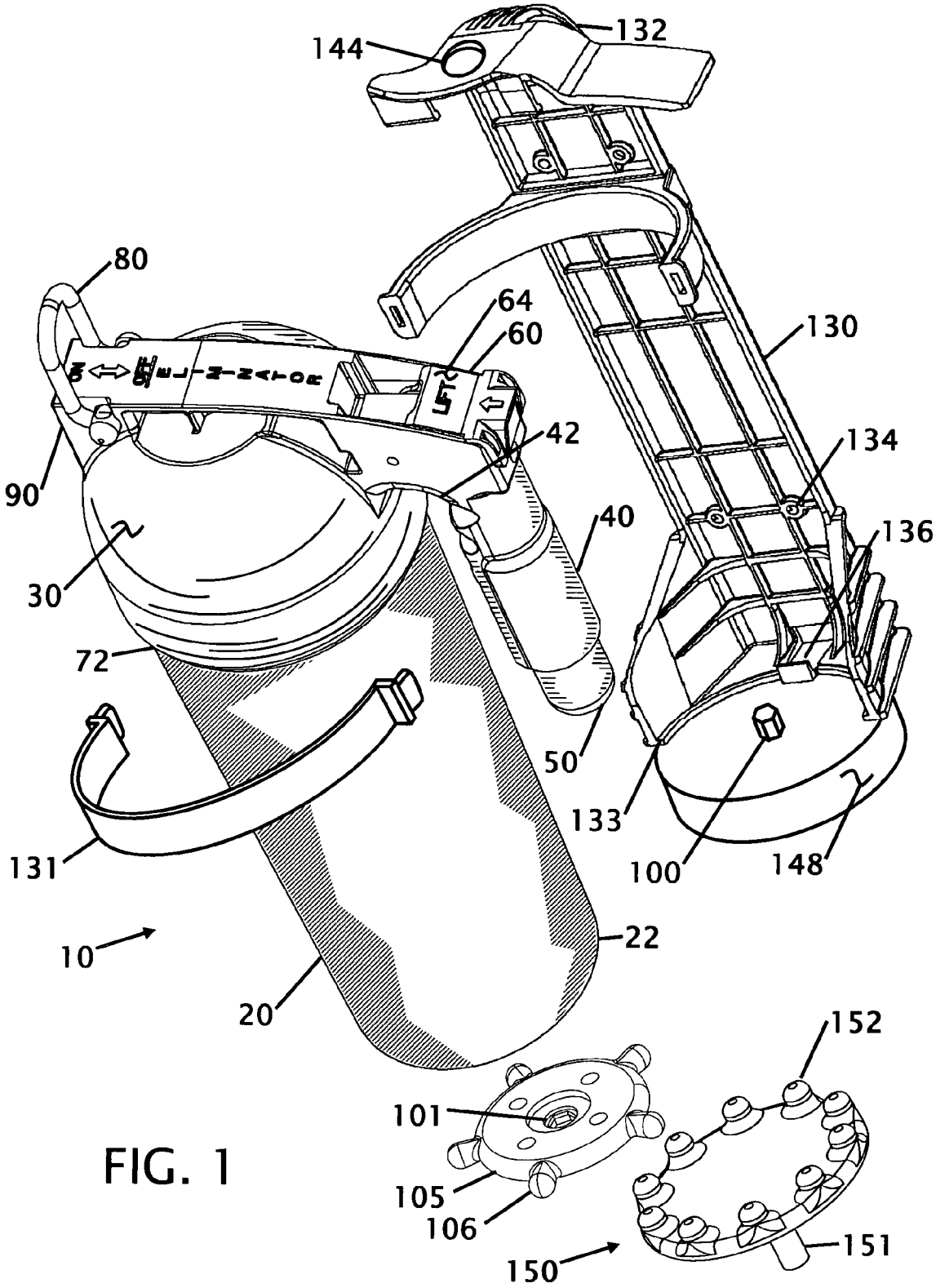
FIG. 1 shows an isometric view of the fire extinguisher, mounting bracket, fluffing wheel and the fluffing chuck.

FIG. 1 an isometric view of the fire extinguisher 10, mounting bracket, fluffing wheel and the fluffing chuck. The chamber 20 is substantially a cylindrical shape with a bottom 22 and a top 30. In the preferred embodiment the chamber is molded from a lightweight resilient material, but it is further contemplated that the chamber be made of aluminum, steel, brass or copper. The preferred embodiment of plastics allows the extinguisher to be placed in locations that could cause corrosion of metals. The top 30 is screwed onto the chamber, but it could also be attached with a bayonet or latching mechanism. The top 30 fits on top of an enlarged opening 72 on the chamber to allow easier filling of the chamber 20 with fire retardant materials. A wall hanging mechanism can be incorporated into the top of the extinguisher, wrap around the body of the cylinder or fork the top of the extinguisher. In this figure the fire extinguisher is shown with a wall mounting mechanism where the fire extinguisher sits on top if the bracket. The bracket is described with more detail below. A handle 40 allows the operator to hold the extinguisher in an upright orientation when it is being used. The fire extinguisher can also be stored and or transported in the upright orientation, but the upright orientation is not critical for the storage or operation of the extinguisher. Within the handle 40 a pressurized canister 50 is located. While in the preferred embodiment the pressurized canister is shown within the handle other locations such as within the top of the extinguisher or adjacent to the hose are contemplated.

The canister 50 consists essentially of a pressurized chamber, but canisters of different types of gas are possible that do not promote spreading of the fire. Because the gas within the canister is under high pressure or in a liquid state, a small canister of pressurized gas is required to expel the contents of the chamber 20. It is also contemplated that multiple pressurized canisters can be placed within the handle to accommodate a larger fire extinguisher without deviating from the inventive nature of the design. Pressurized canisters are available from a variety of sources and can be replaced or serviced without the need to service the entire fire extinguisher. The handle 40 provides some protection to the canister in the event the fire extinguisher is dropped or roughly handled. An arm 42 extends from the underside of the handle 40 to provide structural strength to the top of the fire extinguisher as well as providing a hole for gripping. A flip open door mechanism located on the top of the fire extinguisher 64 and is raised to expose the trigger 60 located under the door 64. The trigger mechanism opens the pressurized canister to pressurize the chamber and expel the fire extinguishing media out the front of the extinguisher out the application nozzle 90.

The location of the activation trigger the fire extinguisher to provide a fire extinguisher that is designed with both the safety pin and the hose retainer for ease of access for right and left handed person. Since the majority of individuals are right handed this creates real problems in life threatening situations. The trigger on top of the fire extinguisher and requires the operator to press down on the extinguisher to operate the extinguisher, but other embodiments are contemplated including but not limited to a finger trigger or a slide mechanism. A safety pin can be incorporated to prevent accidental operation of the extinguisher. The extinguisher is hung from a wall using a fork type holder that is not shown. It is further contemplated that the top housing has an extended tab on one or more side for hanging on an existing wall hanger. The extended tab includes a variety of details located on the top and sides of the extended tab for mounting on wall hangers that are available with older fire extinguisher.

The extinguisher has a powder release valve 80 that is rotated to open the nozzle 90. This valve can be rotated back to the closed position to prevent extinguishing powder from pouring out of the extinguisher when not desired. The path from the pressurized canister 50 to the nozzle 90 is best shown and described in FIG. 2.

Figure 2:
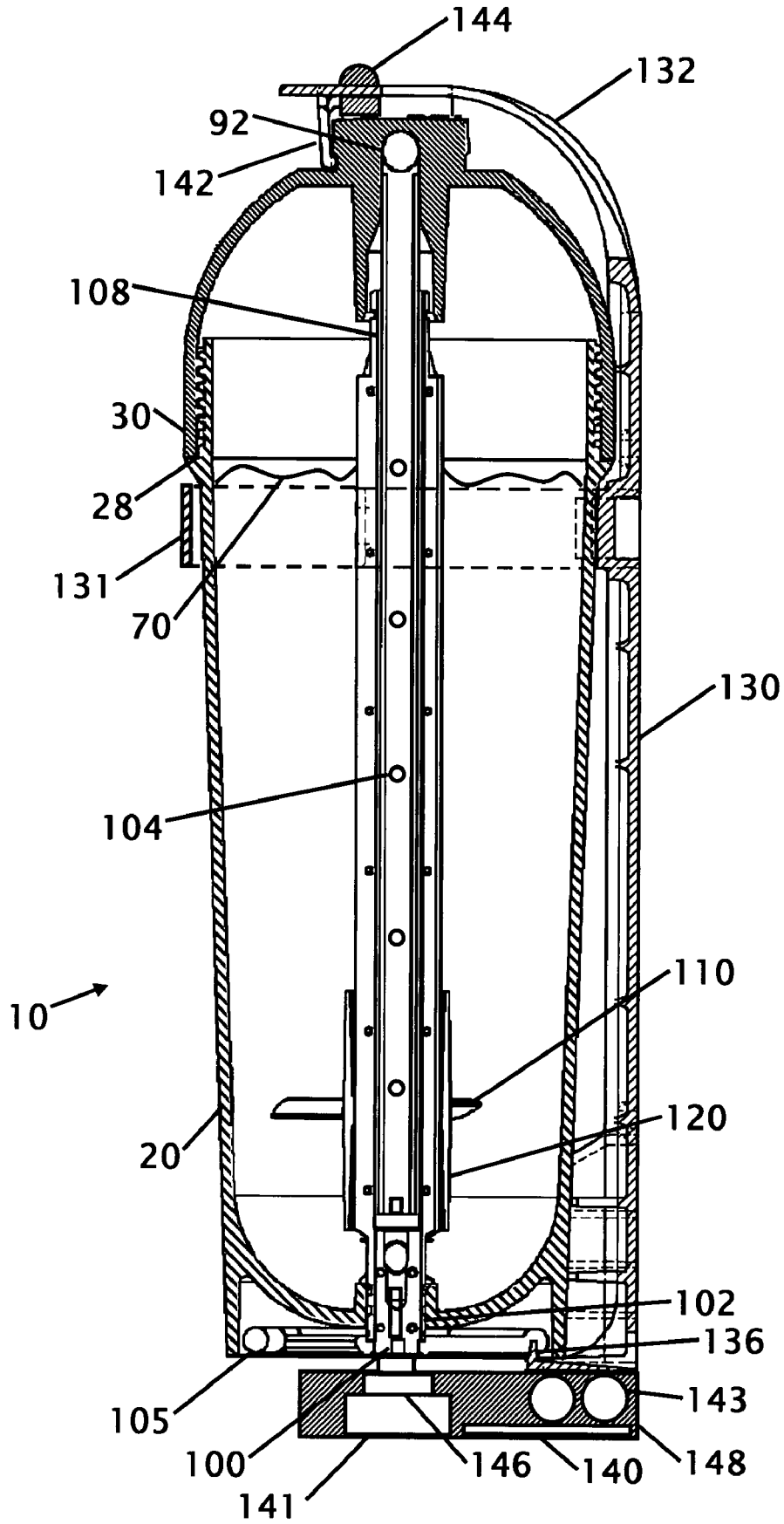
FIG. 2 shows a side sectional view of the fire extinguisher, mounting bracket and the fluffing wheel shown in FIG. 1.

FIG. 2 shows a side sectional view of the fire extinguisher, mounting bracket and the fluffing wheel shown in FIG. 1. This figure shows the chamber 20 filled with the fire extinguishing media 70 such as chemical retardant ABC, BC, Purple K etc. Various types of fire extinguishing media can be placed within the chamber. The upper portion of the chamber includes an enlarged opening 28 where it joins with the top 30 of the extinguisher. The enlarged opening 72 is greater than 50% of the diameter of the cylindrical fire extinguisher, but could be up to and including the same diameter as the cylinder with a threading mechanism located on the exterior lip of the cylinder at one or both ends of the cylinder. Threading or other fastening means is used to secure the top 30 and or bottom of the fire extinguisher onto the cylinder. The fastening means can be with internal or external threading on the cylinder and mating end closures or by methods of fastening such as but not limited to bayonet, pins, welding or adhesives.

It is also contemplated that the cylinder be fabricated from tubular stock where both the top and the bottom of the extinguisher is identical and the ends are attached to the tube when the fire extinguisher is assembled. The bottom of the extinguisher 20 has a port, hole or opening 102 to allow access to the fluffing knob 105. In the preferred embodiment the top opening is between 75% and 90% of the diameter of the fire extinguisher. The larger opening allows the contents of the fire extinguisher to be filled, emptied, inspected, and serviced more easily. The top is screwed onto the chamber, but it could also be attached with a bayonet or latching mechanism. The top 30 of the fire extinguisher provides the propellant and the connections to emit the fire extinguishing material 70.

In this FIG. 2 the chamber is shown to provide a view of the fluffing mechanism(s) 120. The fluffing mechanism conditions the fire retardant media to provide anti-bridging of the media within the chamber to agitate, fluff, turn, disturb, stir, ruffle, and or alters the condition of the media to allow the media to maintain a powder consistency. This allows the fire retardant powder media to remain in a liquefied state so it is easier to spray the powder onto a fire. The conditioning of the media can be performed using a variety of methods and in the preferred embodiment the conditioning is performed with an appendage 110 that can be articulated from the exterior of the chamber at item 100. The appendage is a shaft that extends the length of the chamber and has a number of flaps 120 attached to the appendage. While flaps are shown and used in the preferred embodiment a variety of other appendages are contemplated that can condition the media that include but are not limited to rods, paddles, arms, disks, cable, chains or combination thereof. It is also contemplated that the appendage can be a simple hook or chain that conditions the fire extinguishing media. When the trigger is activated the pressure in canister 50 (FIG. 1) is released into the chamber and the fire suppressant medial 70 is pushed through holes 104 in the central fluffer shaft 108 where it is pushed out hole 92 than exiting out the nozzle 90 (FIG. 1).

The fluffer is formed from two halves of material that is joined to create the fluffing shaft. It is contemplated that the fluffing can be accomplished by blowing gas into the chamber through a hole and through the fluffing shaft to fluff the media within the chamber where the gas blows through the shaft and out fluffing holes 104. As previously described the appendage terminates 100 at the bottom of the chamber with a drive fitting where it can be articulated, but the appendage could terminate at the top or sides of the chamber. The termination at the bottom of the chamber 100 to allow articulation that requires either a key to attach to the appendage, or may terminate with manual knob, handle, wheel or other extension. A manually rotatable handle is shown for manual fluffing of the fire extinguishing media.

Referring back to FIG. 1 the head (delivery system) has an emission port and an entry port plus a pick-up tube. It has a safety guard 64 over the charging pin and a lever 60 to fire the powder through the emission port. The powering cartridge 50 is easily installed in the handle 40 attached to the head of the extinguisher. The powder cartridge has a fluffier tube with an opening to accept the pick-up tube within the head. Current fire extinguishers must be torn down every six years to fluff the powder, check for caking and to check the condition of the chemical. This extinguisher does not have to be broken down; the powder can be fluffed each month, once a year or the chemical cartridge can simple be replaced. The current fire extinguishers have to be subjected to a hydo test every five years for fleet vehicles and every twelve years for the standard extinguishers.

The nozzle 90 can be turned to direct the spray of fire retardant material as desired. A valve handle 80 is rotated up to allow the fire extinguishing media to be expelled and rotated down to block the flow of fire retardant material from falling out of the extinguisher when the tank is tipped. The nozzle is shown in a fixed direction but in another contemplated embodiment the nozzle is flexible to allow a user to hold the fire extinguisher and direct the fire extinguishing media out of the nozzle to a fire. While a nozzle is shown in the preferred embodiment other dispensing orifices can be used such as valves, tubing, spray nozzles or similar are contemplated. It is contemplated that an over pressure relief valve can be incorporated within the fire extinguisher to vent any excessive pressure from within the cylinder that could cause the fire extinguisher to burst due to over pressurization of the chamber.

The mounting bracket is shown without the fire extinguisher installed in FIG. 1 and in cross section in FIG. 2. The bracket is an elongated vertical structure 130 for mounting on the face of a vertical wall. Holes 134 allow the structure to be mounted directly to a wall or similar structure. A horizontal supporting base support 133 extends essentially horizontal from the lower portion of the elongated vertical structure 130 for supporting the bottom of a fire extinguisher. A cover arm 132 extends from the upper portion 132 of the elongated vertical structure to a position over at least a portion of the top of the fire extinguisher placed on the horizontal supporting base such that the arm covers the firing safety 60 and the powder release valve 80.

When the fire extinguisher is installed on the bracket a tab 136 extends vertically from the bottom support 133 and extends under the bottom housing of the fire extinguisher. Another clip 142 wraps around the top of the extinguisher to hold the extinguisher inside the bracket. A powered fluffing mechanism 148 is shown on the bottom of the bracket. The mechanism shown in FIG. 1 shows batteries 143 for a power source but it is also contemplated that the power can come from a wound clock spring type motor. A motor 141 is shown connected to a transmission 146 that is connected either directly to the bottom drive mechanism 100 of the fluffing shaft mechanism 120 or to an intermediary fluffing knob 105. A circuit board 140 is shown in FIG. 2 that provides control for an alarm, a visual indicator light 144 and control of the motor 141.

A strap 131 wraps around the fire extinguisher and snaps into the bracket to retain the fire extinguisher 10. FIG. 1 shows one contemplated design of a fluffer knob 105. The knob is a flattened toroidal shaped body with a plurality of elongated arms 106 extending horizontally from the flattened plainer toroidal shaped body. A geometric opening 101 that is concentric with the flattened toroidal shape is used to attach the knob 105 to the fire extinguisher having external powder fluffing capability.

A chuck 150 is shown in FIG. 1 where the elongated end 151 of the chuck 150 is configured for use with a conventional drill. The chuck 150 has a number of fingers 152 that engage in the arms 106 of the fluffing knob 105.

Figure 3:
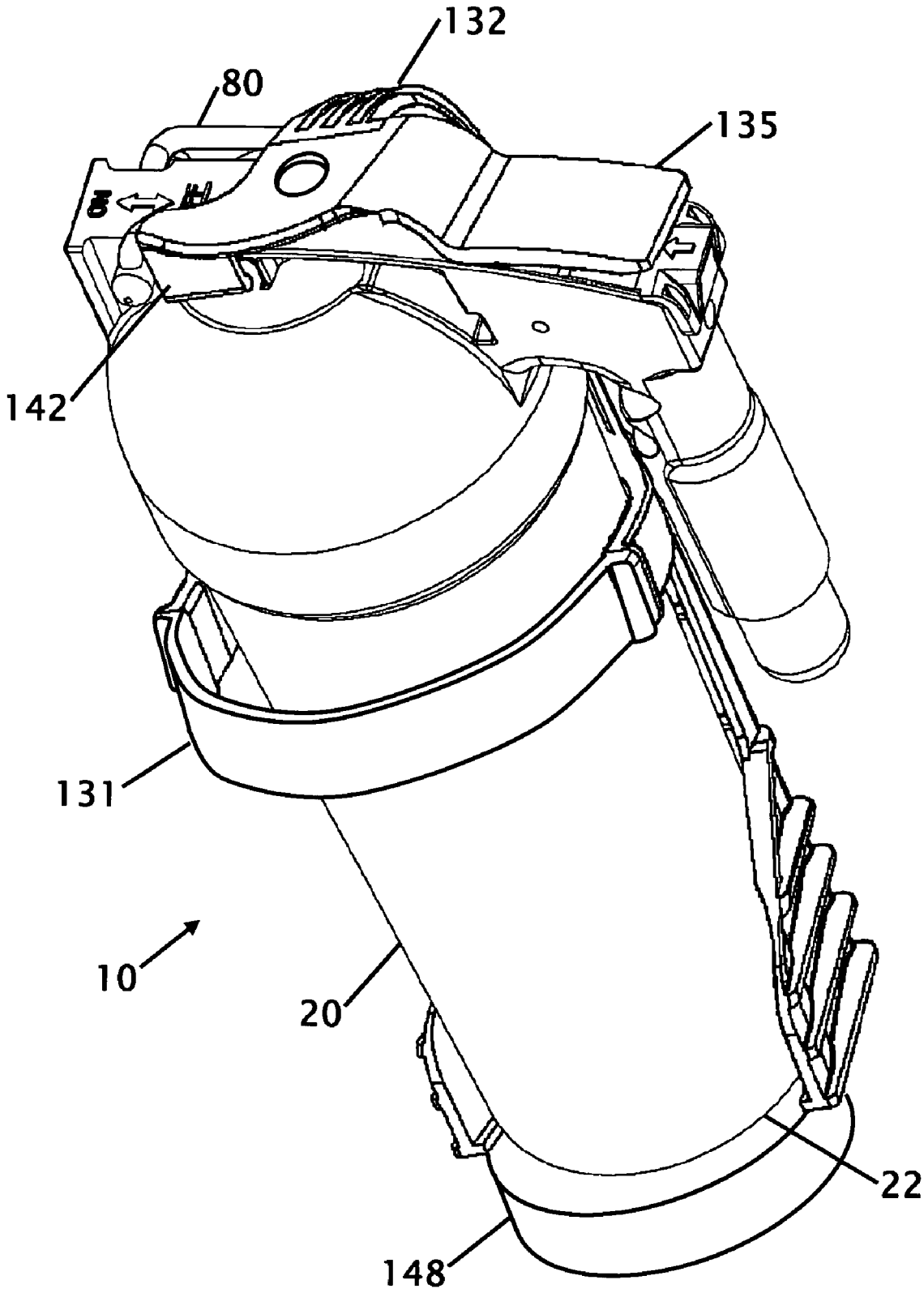
FIG. 3 shows an exterior isometric view of the fire extinguisher mounted in the mounting bracket as shown in FIG. 1.

FIG. 3 shows an exterior isometric view of the fire extinguisher 10 mounted in the mounting bracket. The bottom 22 of the extinguisher 20 is shown sitting on top of the motorized housing 148 as shown in FIG. 1. The extinguisher 10 is mounted in the bracket. The front strap 131 wraps around the body of the extinguisher. The powder release handle 80 is under the top arm 132. The arm 132 extends over the activation portion 135 of the extinguisher to cover the trigger.

Figure 4:
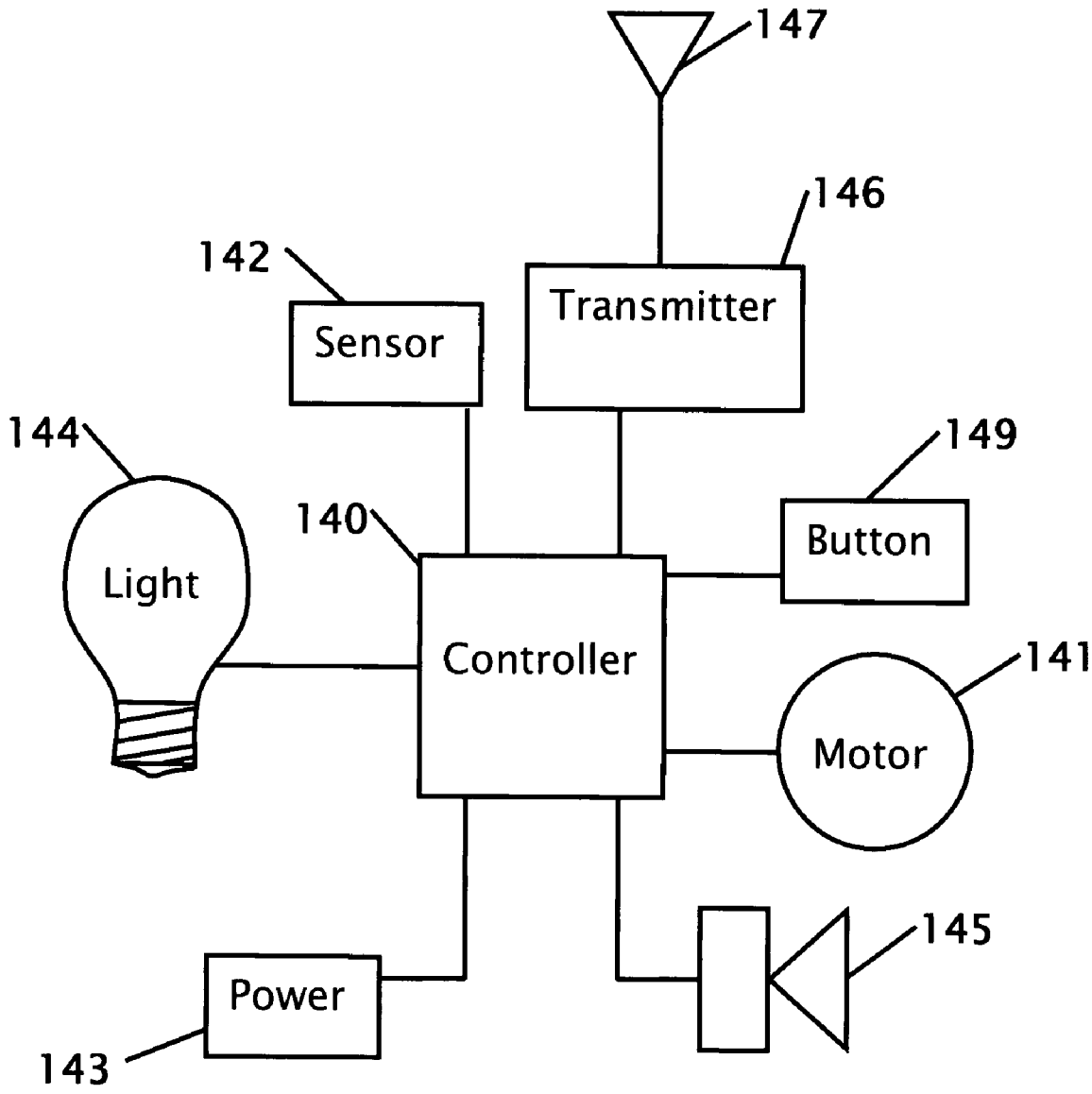
FIG. 4 shows block diagram of the electronic circuit for the control, drive and signaling mechanism.

FIG. 4 shows block diagram of the electronic circuit for the control, drive and signaling mechanism. This block diagram is one contemplated configuration having a central controller 140. The central controller 140 may include electronics that periodically activate the motor 141 to turn the fluffer for a temporal period of time. One or more sensors 142 detect tampering or use of the fire extinguisher and can turn on lighting 144, and alarm 145 or transmit 146 a signal to another location using a wireless 147 or wired connection. The signal may include a location where the extinguisher was located, or other encoded information that provides information regarding the particular fire extinguisher including when it was serviced or fluffed. Another sensor or button 149 is used to manually activate the motor or the test the device. In the preferred embodiment the power is supplied by one or more batteries 143 that are replaceable, rechargeable or solar charged.

Thus, specific embodiments of an improved fire extinguisher have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A mounting bracket for a fire extinguisher comprising:

an elongated vertical structure for mounting on the face of a vertical surface;

a horizontal supporting base that extends essentially horizontal from a lower portion of the elongated vertical structure for supporting the bottom of the fire extinguisher, and an arm that extends from an upper portion of the elongated vertical structure to a position over at least a portion of the top of the fire extinguisher placed on the horizontal supporting base such that the arm covers at least a portion of a firing mechanism and covers access to a safety pin on the fire extinguisher.

2. The mounting bracket for a fire extinguisher according to claim 1 wherein the elongated vertical structure includes at least one hole or slot for use with a fastener to secure the structure to an essentially flat surface.

3. The mounting bracket for a fire extinguisher according to claim 1 wherein the horizontal surface further includes a vertical protrusion that is adapted to engage in the underside of the fire extinguisher.

4. The mounting bracket for a fire extinguisher according to claim 1 wherein the arm covers the fire extinguishers activation mechanism.

5. The mounting bracket for a fire extinguisher according to claim 1 that further includes a signaling mechanism that is activated when the fire extinguisher is removed from the mounting bracket.

6. The mounting bracket for a fire extinguisher according to claim 5 wherein the signaling mechanism include at least one of a light, audible alarm, wireless transmitted signal.

7. The mounting bracket for a fire extinguisher according to claim 1 wherein the mounting bracket is made from a material that glows in the dark.

8. The mounting bracket for a fire extinguisher according to claim 1 that further includes a mechanism that is adapted to engage with the fire extinguisher to fluff fire extinguishing media within the fire extinguisher.

9. A fluffing mechanism for a portable fire extinguisher comprising:

a drive motor;

a transmission connecting the drive motor;

an output shaft connected to the transmission wherein the output shaft is configured for connection with a fluffing shaft mechanism of the fire extinguisher having powder fluffing capability, and further includes a retention mechanism for retaining the fire extinguisher on the fluffing mechanism with an activation mechanism that engages the drive motor to turn for a temporal period.

10. The fluffing mechanism for a portable fire extinguisher according to claim 9 wherein the drive motor is electrical or a mechanical wound clock spring motor.

11. The fluffing mechanism for a portable fire extinguisher according to claim 9 wherein the transmission is a speed reducing transmission that reduces the RPM from the motor to the output shaft.

12. The fluffing mechanism for a portable fire extinguisher according to claim 9 that further includes an automatic activation mechanism that periodically operates the motor.

13. The fluffing mechanism for a portable fire extinguisher according to claim 12 that further includes a signaling mechanism that is activated when the fire extinguisher is removed from the retention mechanism.

14. The fluffing mechanism for a portable fire extinguisher according to claim 12 that further include a covering over an activation mechanism on the fire extinguisher to prevent tampering of the fire extinguisher.

15. A fluffing wheel for a portable fire extinguisher comprising:

a flattened plainer toroidal shaped body;

a plurality of elongated arms extending horizontally from the flattened plainer toroidal shaped body, and a geometric opening concentric with the flattened plainer toroidal shape body for attaching the flattened plainer toroidal shaped body to a fire extinguisher having external powder fluffing capability.

16. The fluffing wheel for a portable fire extinguisher according to claim 15 that further includes a fluffing chuck that is usable with a power drill to engage the fluffing chuck with the fluffing wheel.

17. The fluffing wheel for a portable fire extinguisher according to claim 15 wherein the fluffing chuck includes a first end with an elongated shaft and a second end having a plurality of fingers configured to couple with the plurality of elongated arms extending horizontally from the flattened plainer toroidal shaped body of the fluffing wheel.

18. The fluffing wheel for a portable fire extinguisher from claim 15 wherein five elongated arms extend horizontally from the body of the flattened plainer toroidal shaped body a sufficient length to allow the entire fluffing wheel to nest within the bottom housing of the fire extinguisher having external powder fluffing capability.

* * * * *